US005864278A

United States Patent [19]

Becher

[11] Patent Number: 5,864,278

[45] Date of Patent: Jan. 26, 1999

[54] SWITCH HAVING A TEMPERATURE-DEPENDENT SWITCHING MECHANISM

[75] Inventor: Michael Becher, Althengstett, Germany

[73] Assignee: Thermik Gerätebau GmbH, Pforzheim, Germany

[21] Appl. No.: 808,489

[22] Filed: Mar. 3, 1997

[30] Foreign Application Priority Data

Mar. 19, 1996 [DE] Germany ..... 196 09 310.4

[51] Int. Cl.[6] ..... H01H 37/04

[52] U.S. Cl. ..... 337/380; 337/373; 337/343

[58] Field of Search ..... 337/16, 333, 342, 337/343, 380, 381, 388, 373

[56] References Cited

U.S. PATENT DOCUMENTS 3,818,410 6/1974 Hire ..... 337/354
4,470,033 9/1984 Hofsass ..... 337/343
4,490,704 12/1984 Snider et al. .

FOREIGN PATENT DOCUMENTS 2121802 3/1974 Germany .
3710672 10/1988 Germany .
WO9220086 11/1992 WIPO .

*Primary Examiner*—Leo P. Picard
*Assistant Examiner*—Jaypradkash N. Gandhi
*Attorney, Agent, or Firm*—Harness, Dickey & Pierce, P.L.C.

[57] ABSTRACT

A switch comprises a housing which receives a temperature-dependent switching mechanism and has a lower part on whose inner base a first countercontact for the switching mechanism is arranged. Also provided is a cover part, closing off the lower part, on whose inner side a second countercontact for the switching mechanism is provided. The switching mechanism creates, as a function of its temperature, an electrically conductive connection between the two countercontacts, to which contact can be made from outside. The lower part is made of insulating material, and contact can be made from outside with the first countercontact through a wall of the lower part. The cover part is made of electrically conductive material and simultaneously acts as the second countercontact, the cover part being held on an upper rim of the lower part.

12 Claims, 2 Drawing Sheets

SWITCH HAVING A TEMPERATURE-DEPENDENT SWITCHING MECHANISM

BACKGROUND OF THE INVENTION

1. Field of the Invention

The present invention relates to a switch having a housing which receives a temperature-dependent switching mechanism and has a lower part on whose inner base a first countercontact for the switching mechanism is arranged, as well as a cover part, closing off the lower part, on whose inner side a second countercontact for the switching mechanism is provided, the switching mechanism creating, as a function of its temperature, an electrically conductive connection between the two counter-contacts, to which contact can be made from outside.

2. Related Prior Art

A switch of this kind is known from DE 37 10 672 A1.

In the case of the known switch, the housing has a lower part made of electrically conductive material as well as a cover part, closing off the lower part, that is made of insulating material. The switching mechanism, which comprises a spring disk that carries a movable contact element, is arranged in this housing. The spring disk operates against a bimetallic snap disk that is slipped over the movable contact element. Below the switching temperature the spring disk, which is braced against the base of the lower part, presses the movable contact element against a countercontact that is provided on the inside of the cover and extends outward, in the manner of a rivet, through the cover. The base of the lower part serves as further countercontact for the switching mechanism.

Since the spring disk itself is made of electrically conductive material, below the response temperature of the switching mechanism it provides a low-resistance electrically conductive connection between the countercontact on the cover part and the countercontact on the lower part, contact being made from outside to the lower part. If the temperature of the switching mechanism is then increased, the bimetallic snap disk suddenly snaps over and pushes the movable contact element, against the force of the spring disk, away from the countercontact on the cover, so that the electrical connection is broken.

Switches of this kind are commonly used for temperature monitoring of electrical devices. As long as the temperature of the electrical device does not exceed a predetermined response temperature, the switch, which for this purpose is connected in series with the load being protected, remains closed. If the temperature of the load then increases excessively, the bimetallic snap disk snaps over and thus interrupts the flow of current to the load.

It is a disadvantage of the known switch that it is relatively complex to produce. This is due principally to the fact that after production of the cover part, the countercontact must then be fastened onto the cover part; at the same time, an electrically conductive connection out through the wall of the cover part must be provided. This is done in the manner of a rivet that transitions, outside the cover, into a head to which conductors, crimp terminals, etc. can be soldered. This assembly of the countercontact to the cover is generally performed manually, and is thus very cost-intensive.

A further switch, in whose housing a temperature-dependent switching mechanism as described above is also arranged, is known from DE 21 21 802 A. In this switch the cover part and lower part are both cup-shaped, and are made of electrically conductive material. One-piece crimp terminals are shaped onto both the upper part and the lower part, the crimp terminal of the lower part extending outward through a corresponding cutout in the wall of the upper part. An insulating film is arranged between the upper part and the lower part in order to insulate the two housing parts electrically from one another.

The temperature-dependent switching mechanism thus makes contact on the one hand with the lower part via the spring disk, and on the other hand with the cover part via the movable contact element, so that an electrically conductive connection between the two crimp terminals exists as long as the temperature of the switching mechanism is below the response threshold. If the temperature of the switching mechanism rises, this electrical connection is broken in the manner described above.

Final assembly of this switch is also very complex due to the insulating film that must be introduced, and therefore can only be accomplished manually. This manual final assembly is not only wage-intensive, but also leads to assembly errors and thus to a higher reject rate.

A further disadvantage of both switches described so far is the fact that for certain applications they must be additionally insulated externally, since current flow occurs via the electrically conductive lower housing part.

A further temperature-dependent switch which has a lower housing part made of insulating material and a cover, made of metal, that rests on a shoulder of the lower part and is held by a rim of the lower part, is known from U.S. Pat. No. 4,490,704. The temperature-dependent switching mechanism comprises a bimetallic spring, clamped at one end, that at its free end holds a movable contact that is in contact, below the response temperature of the switching mechanism, with a fixed countercontact that is arranged on the inside of the cover.

At its other end, the bimetallic spring is firmly clamped and connected to a resistor that extends on the base of the lower part. A through hole, into which a knob-like connector element is inserted from below, is provided in the base. This connector element is soldered to the resistor at its head projecting into the interior of the switch. The knob-like head continues into a bracket that extends laterally under the wall of the lower part and continues, alongside the lower part, into a connector lug.

This document therefore describes a temperature-dependent switching mechanism completely different from the two documents cited above; because of the bimetallic spring clamped at one end, the demands in terms of insulation of the switching mechanism are less stringent in the various switching states.

Because of the knob-shaped connector element, making contact with the clamped-in end of the bimetallic spring is very laborious: not only are parts of complex shape required, but because the knob-like head is soldered to the resistor in the interior of the lower part, assembly is very laborious. A further disadvantage of this switch is that it is uninsulated at both the top and the bottom, so that particular precautionary measures are required when installing it on the device to be protected.

SUMMARY OF THE INVENTION

In view of the above, it is an object of the present invention to improve the switch mentioned at the outset in such a way that it is economical to assemble and has a simple design.

According to the invention this object is achieved, in the case of the switch mentioned at the outset, by the fact that the lower part is made of insulating material, that contact can be made from outside with the first countercontact through a wall of the lower part, and that the cover part is made of electrically conductive material and simultaneously acts as the second countercontact, the cover part preferably being introduced into the lower part and held on and by an upper rim of the lower part.

The object on which the invention is based is completely achieved in this manner. Since the lower part is now produced from insulating material, no insulating film is needed in order to provide suitable electrical insulation between the lower part and cover part. A further advantage is that the cover part itself acts as the countercontact, so that making contact through the cover part, which is complex in the related art, is eliminated. This contact from outside can be achieved much more simply in the case of the lower part by the fact that, for example, a slot is provided in the wall of the lower part through which a connector element of the first countercontact extends outward. The lower part can thus be produced as a cup with an elongated slot in its outer wall; the first countercontact then simply needs to be introduced so that its outwardly projecting connector element lies in the slot. The bimetallic switching mechanism is then introduced, preferably in reverse order compared to what has previously been commonly known, and lastly comes the cover part that is held directly on the rim of the lower part, snap lugs being, for example, provided there. The entire assembly of the new switch is thus very simple; in addition, relatively few components are required, so that costs for the new switch remain very low because of its simple design.

The outer base of the lower part can be used as an insulating mounting surface, so that the new switch can be more easily installed on a device to be protected.

It is preferred in this context if, during the manufacture of the lower part, the first countercontact is held in lossproof fashion in the lower part, by encapsulation or injection-embedding, in such a way that it is an integral component of the lower part.

The advantage here is that the lower part can now be produced as, for example, an injection-molded plastic part, the first countercontact being directly injection-embedded during the injection process so that it becomes an integral component of the lower part. In other words, attachment of the countercontact to the base of the lower part is performed concurrently during the manufacture of this lower part, so that several operations can be eliminated here. Moreover, the first countercontact is completely insulated externally by means of the injection-embedding, so that subsequent insulation by means of epoxy or an insulating cap, as was previously known, is superfluous.

In an embodiment, it is preferred if the first countercontact has a shaped-on connector element that projects outward through a wall of the lower part.

The advantage here is that both installation of the first countercontact onto the lower part and through-contacting of it outward through the wall can be accomplished integrally, in one operation, during production of the lower part. The countercontacts with shaped-on connector elements can, for example, be delivered in ribbon form on a belt, whereupon an injection-molding machine injection-embeds one countercontact after another into a lower housing part. All that is then necessary is to introduce the bimetallic switching mechanism into this lower part, whereupon it is then closed off with the cover part that simultaneously functions as the second counter-contact. The overall result, therefore, is very few production steps for complete manufacture of the new switch, so that the costs for such switches can be kept very low.

In a preferred embodiment, the first countercontact is in this connection an electrically conductive ring or an electrically conductive disk; preferably it is configured as a punched sheet-metal part on which the connector element is integrally configured. The second countercontact is also preferably configured as a punched sheet-metal part with a shaped-on connector element.

These features are on the one hand of design advantage, since disks and rings, preferably as punched sheet-metal parts, are particularly simple and economical to produce and easy to encapsulate or injection-embed, so that production of the lower part with an integral countercontact arranged therein can be accomplished very economically and easily. After such production, the connector element then automatically extends outward through a lateral wall of the lower part.

In the case of the configuration as a disk, it is furthermore advantageous that better thermal coupling is achieved between the new switch, through the base of the lower part made of insulating material, and the device to be protected in terms of temperature change, than in the case of a ring.

If the first countercontact is, however, configured as a ring, the result is a large open region in its center made of insulating material, with which the movable contact element of the bimetallic switching mechanism can come into contact without resulting in electrical contact with the countercontact, so that the insulating disk otherwise necessary in some cases between the bimetallic switching mechanism and the cover part can be dispensed with here.

Specifically, it is preferred in the case of the switching mechanism if it comprises an electrically conductive spring disk which carries a movable contact element and operates against a bimetallic snap disk that sits approximately centeredly on the movable contact element, the spring disk being braced at its rim against a countercontact and the movable contact element pressing against the other countercontact when the switching mechanism is below its response temperature.

Bimetallic switching mechanisms of this kind are commonly known from the related art; they have the advantage that current flow occurs through the spring disk, so that the bimetallic snap disk does not experience internal electrical heating and is thus not disadvantageously or unpredictably influenced in terms of its response characteristics. When a switching mechanism of this kind is now arranged in the new switch, the spring disk is then braced against the first countercontact and presses the movable contact part against the second countercontact. When the temperature of the switching mechanism rises, the bimetallic snap disk snaps over and is now braced with its rim against the inside of the cover part, thus pressing the movable contact element with the spring disk downward onto the base of the lower part. If the first contact is now configured as a ring, the movable contact element does not come into contact with it, so that the electrical connection between the outer terminals of the new switch is interrupted, although the spring disk is now braced at its rim against the inside of the cover part.

If the first countercontact is configured, for the sake of better heat transfer, as a disk, an insulating disk must simply be introduced between the bimetallic snap disk and the cover part so as to prevent, in the high-temperature position, any contact between the rim of the spring disk and the second countercontact, and thus any undesirable short-circuit.

In an embodiment, however, it is preferred if the first counter-contact has an approximately centered contact projection with which the movable contact element of the switching mechanism is in contact when being below its response temperature.

The advantage here is that the switching mechanism is placed into the housing "upside down," so to speak, so that below the response temperature the spring disk is now braced at its rim against the cover part. One advantage of this arrangement is simple assembly, since now the bimetallic snap disk can first be introduced into the lower part, where it also optionally centers itself on the contact projection. The spring disk with welded-on contact element is then introduced and also automatically centers itself in the opening of the bimetallic snap disk, so that the new switch can now be assembled automatically.

In an embodiment, the lower part now overlaps the first counter-contact in annular fashion, so that an insulating contact region is formed on the first countercontact.

The advantage here is that this insulating contact region can be produced concurrently during injection-molding or encapsulation of the lower part, thus making the use of an additional insulating disk superfluous. If the switching mechanism is then installed "upside down" into the housing, the spring disk is then, below the response temperature, braced at its rim against the cover part, and presses the movable contact part against the contact projection. Above the response temperature, the spring disk now rests at its rim on the insulating contact region, so that although the center region of the spring disk and the bimetallic snap disk are resting against the cover part, no further short-circuit can occur between the two counter-contacts. This very simply designed feature thus once again considerably reduces the complexity during final assembly of the new switch. It also improves quality and productivity, since in the case of known switches the insulating cap and/or insulating film are mechanically stressed during the production process, which can cause cracks that lead to short-circuits. These problems do not occur with the new switch.

It is particularly worth emphasizing here that the number of operations is also drastically reduced: after the first counter-contact is injection-embedded, the bimetallic snap disk and spring disk simply need to be introduced into the lower part, which is then simply closed off with the cover part. These operations are now so simple that they can easily be automated.

The cost advantage with the new switch lies, however, not only in the small number of assembly steps and the possibility of automating assembly; a further advantage is achieved by the fact that the insulating disk can now be entirely dispensed with. In the case of the related art, this insulating disk must meet a whole series of requirements in terms of dielectric strength, etc., so that it is a very cost-intensive component whose price has a perceptible effect on the total price of the known switch. Since this insulating disk can therefore now be dispensed with, the result is again a further considerable reduction in the costs of the new switch.

It is generally preferred if the cover part rests on an inner shoulder of the lower housing part, the rim of the lower housing part preferably being hot-pressed or heat-welded after the cover part is put in place.

These features on the one hand make possible easy positioning of the cover part; hot-pressing or heat-welding results, on the other hand, in much better retention of the cover part on the lower part than would have been the case with the aforementioned snap lugs. Moreover, the received switching mechanism is thereby electrically insulated and particularly well sealed against external influences.

Further features and advantages are evident from the description and the appended drawings.

It is understood that the features mentioned above and those yet to be explained below can be used not only in the respective combinations indicated, but also in other combinations or in isolation, without leaving the context of the present invention.

BRIEF DESCRIPTION OF THE DRAWINGS

Embodiments of the invention are shown in the drawings and will be explained in more detail in the description below. In the drawings.

DETAILED DESCRIPTION OF PREFERRED EMBODIMENTS

Figure 1:
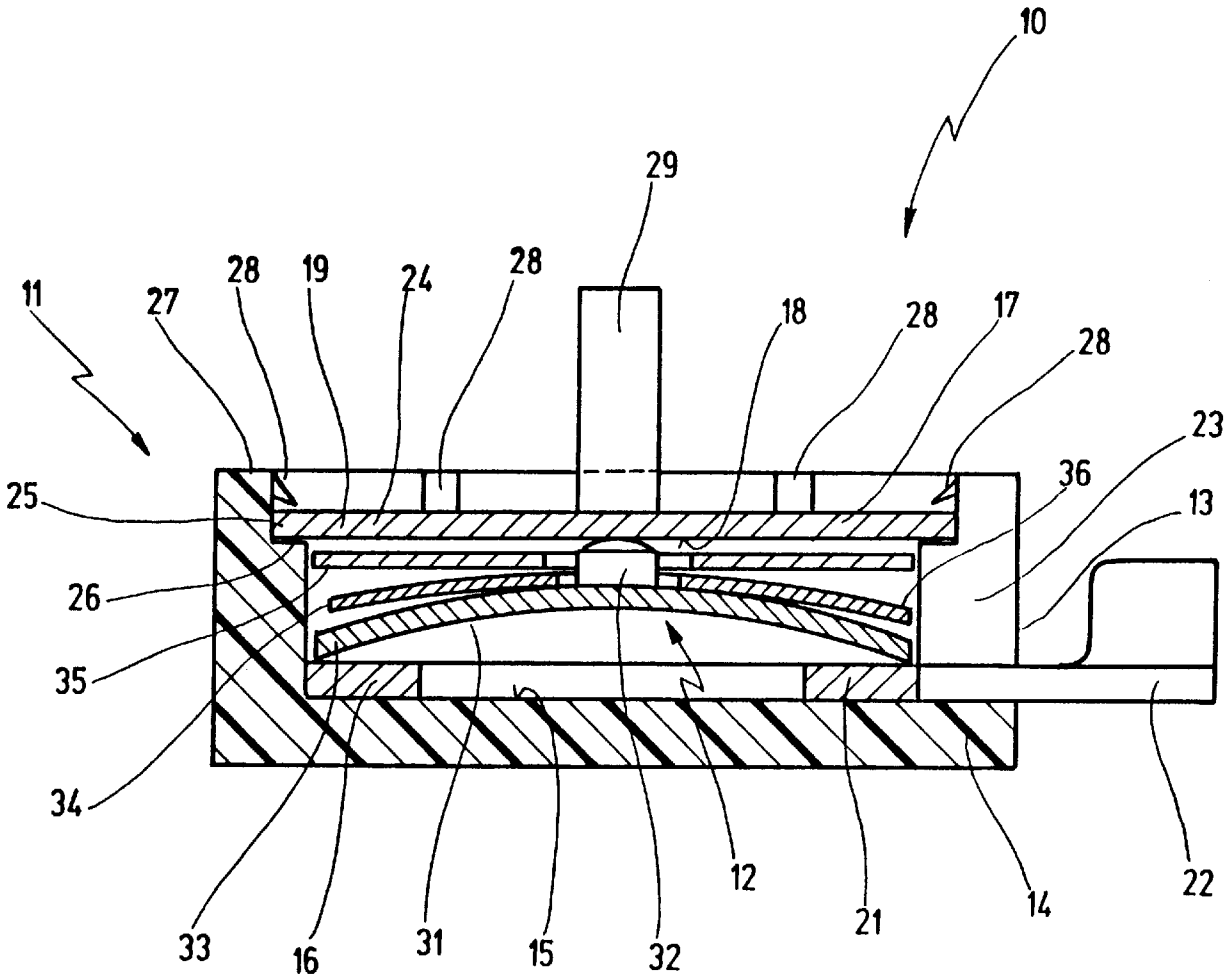
FIG. 1 shows the new switch in a first exemplified embodiment, in a schematic sectioned representation in a side view.

In FIG. 1, 10 indicates a switch in whose housing 11 a temperature-dependent switching mechanism 12 is arranged. Switches of this kind are used, for example, to monitor the temperature of electrically driven devices, and for this purpose are connected electrically in series with the device.

Housing 11 comprises a lower part 14 which has a wall 13 and on whose inner base 15 a first countercontact 16 for switching mechanism 12 is arranged. Lower part 14 is closed off by a cover part 17 on whose inner side 18 a second countercontact 19 is provided.

While lower part 14 is made of electrically insulating material, cover part 17 is electrically conductive, so that it itself functions as the second countercontact.

First countercontact 16 is configured as a ring 21 whose connector element 22 extends outward through a slot 23 in wall 13. During assembly of switch 10, ring 21 is introduced into the interior of lower part 14 in such a way that connector element 22 slides downward through slot 23. This slot 23 can be very thin, so that it does not impair the function of the new switch. It is possible, however, to encapsulate or hot-press slot 23 after first countercontact 16 has been introduced.

Second countercontact 19 is configured as a disk 24 that is braced at its rim 25 on an inner circumferential shoulder 26 of lower part 14. Extending beyond rim 25 of disk 24 is a rim 27 of lower part 14. Snap lugs 28 which hold disk 24 on shoulder 26 in lossproof fashion are provided on this rim 27.

Also evident from FIG. 1 is the fact that a connector element 29 of second countercontact 19 extends upward inside rim 27, where contact is made with it in suitable fashion.

Switching mechanism 12 comprises a spring disk 31 which carries a movable contact element 32 that, in the exemplified embodiment shown, is welded onto spring disk 31. Spring disk 31 is braced at its rim 33 on ring 21, and in the low-temperature position shown in FIG. 1 presses movable contact element 32 against disk 24 so that globally, an electrical connection between connector elements 22 and 29 is created via the electrically conductive spring disk 31.

A bimetallic snap disk 34 and an insulating disk 35 are slipped over movable contact element 32.

If the temperature of switch 10 then rises above the response temperature of switching mechanism 12, bimetallic snap disk 34 thus suddenly snaps over and is now braced at its rim 36, via insulating disk 35, against inner side 18 of cover part 17. The bimetallic snap disk thereby presses movable contact element 32, against the force of spring disk 31, away from disk 24 which constitutes the second countercontact. The electrical connection between the two connector elements 22 and 29 is thus interrupted.

During assembly of the switch shown in FIG. 1, the first contact element 16 is first introduced into lower part 14, then spring disk 31, bimetallic spring disk 34, and insulating disk 35 are introduced. Then cover part 17 is introduced into rim 27 of lower part, and pushed down until snap lugs 28 overlap disk 24 and hold it in loss-proof fashion, i.e. it "snaps in."

Figure 2:
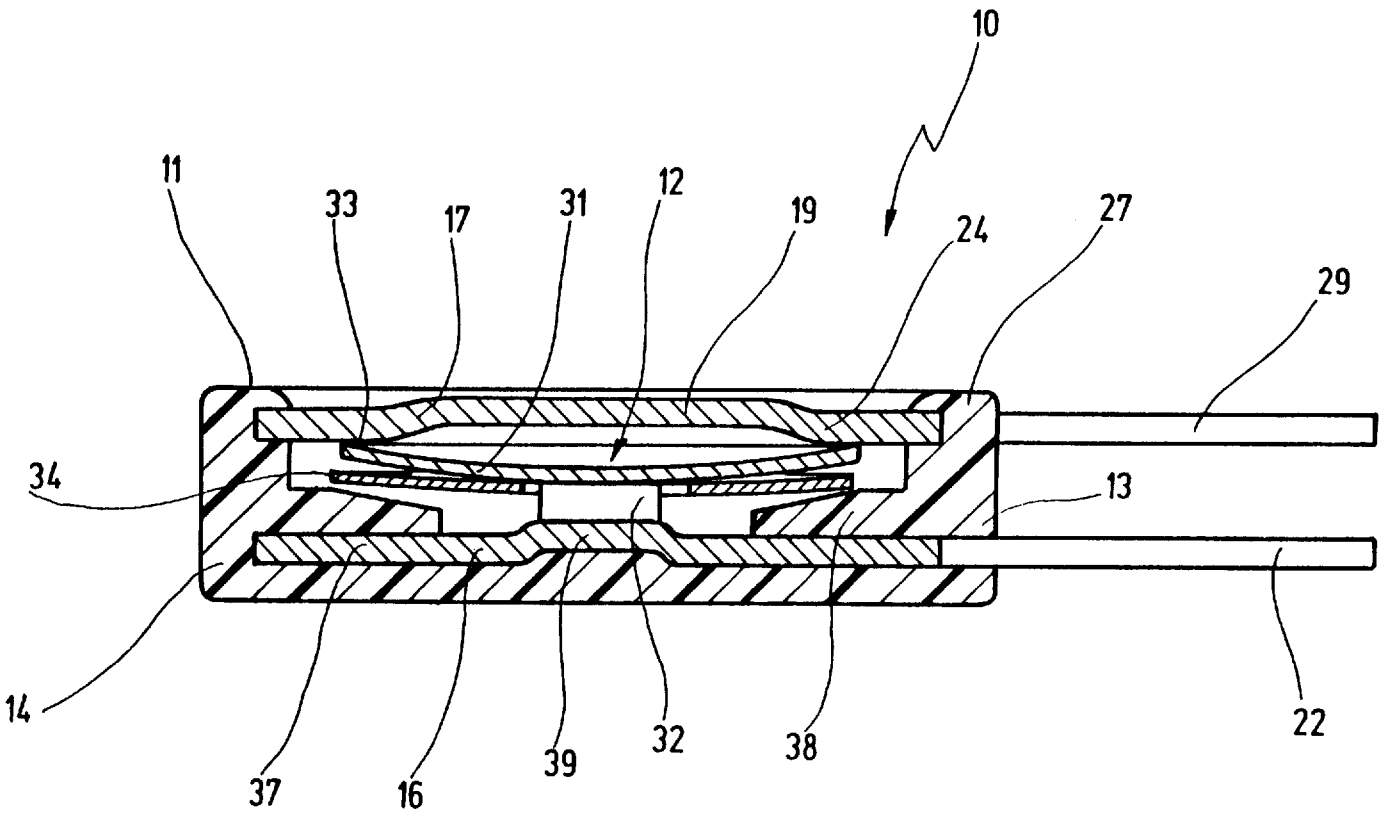
FIG. 2 shows, in a representation like FIG. 1, a second exemplified embodiment of the new switch.

FIG. 2 shows a further embodiment of the new switch 10 in which the first countercontact is also configured as a disk 37. Disk 37 is overlapped in annular fashion at its circumference by lower housing part 14, resulting in an insulating contact region which insulates disk 37 at its rim toward the top as well.

Disk 37 additionally has, approximately centeredly, a contact projection 39 that faces into the interior of housing 11.

In the embodiment of FIG. 1, countercontact 16 is now injection-embedded or encapsulated during the production of lower part 14, so that it is an integral component of lower part 14.

The bimetallic switching mechanism in FIG. 2 is introduced "upside down" as compared with FIG. 1, so that in the low-temperature position shown in FIG. 2, movable contact element 32 is in contact with contact projection 39. Spring disk 31 is braced at its rim 33 against the inside of cover part 17 so that a conductive connection is created between connector elements 22, 29, which both extend laterally through wall 13 of lower part 14.

In this context, connector element 29 lies in a cutout (not evident in FIG. 2) in rim 27, so that it can be introduced later from above. It is evident that rim 27 overlaps disk 24 at its rim, and thus holds it in lossproof fashion. This attachment is achieved by the fact that after disk 24 is introduced, a rim 27 that originally stands straight up is hot-pressed or heat-welded so that it at least partly overlaps disk 24. If rim 27 is of suitable height, it is also possible to provide enough insulating material that disk 24 is insulated externally even when rim 27 is hot-pressed.

In other words, this type of assembly creates a switch that is completely insulated from the outside, out of which only the two connector elements 22 and 29 project. Since both countercontacts 16 and 19 are configured as disks 37 and 24, good thermal coupling to the outside is nevertheless possible.

In the case of switch 10 of FIG. 2, insulating contact region 39 means that insulating disk 35 shown in FIG. 1 can also be dispensed with. The reason is that when switching mechanism 12 is heated sufficiently that bimetallic snap disk 34 jumps into its high-temperature position, the latter is then braced against insulating contact region 38 and presses movable contact element 32 away from contact projection 39 until ultimately spring disk 31 also snaps over from the concave shape shown into a convex shape. Spring disk 31 and bimetallic snap disk 34 are then braced at their rims against insulating contact region 38, so that any possible contact in the region of movable contact element 32 with cover part 17 does not lead to an undesirable short-circuit between the two connector elements 22 and 29.

What I claim, is:

1. A switch, comprising a temperature-dependent switching mechanism, a housing containing said temperature-dependent switching mechanism, said housing including a lower part having an inner base, a first countercontact for cooperating with said temperature-dependent switching mechanism being arranged at said inner base, said lower part being made of insulating material and having an upper rim, and a sidewall, contact being made to said first countercontact through said sidewall of said lower part, said housing further including a cover part closing off said lower part and being held at said rim of said lower part, said cover part being made of electrically conductive material and cooperating as a second countercontact with said temperature-dependent switching mechanism, said temperature-dependent switching mechanism creating, as a function of its temperature, an electrically conductive connection between said first and second countercontacts.

2. The switch of claim 1, wherein the first countercontact is captively held in the lower part, by injection-embedding, in such a way that it is an integral component of the lower part.

3. The switch of claim 2, wherein the first countercontact has a shaped-on connector element that projects outward through a sidewall of the lower part.

4. The switch of claim 1, wherein the first countercontact is configured as an electrically conductive ring.

5. The switch of claim 1, wherein the first countercontact is configured as an electrically conductive disk.

6. The switch of claim 3, wherein the first countercontact is configured as a punched sheet-metal part on which the connector element is integrally configured.

7. The switch of claim 3, wherein the second countercontact is a punched sheet-metal part with a shaped-on connector element.

8. The switch of claim 1, wherein the cover part rests on an inner shoulder of the lower part.

9. The switch of claim 1, wherein the rim is hot-pressed after introduction of the cover part.

10. The switch of claim 1, wherein the switching mechanism comprises an electrically conductive spring disk which carries a movable contact element and operates against a bimetallic snap disk that sits approximately centeredly on the movable contact element, the spring disk being braced at its rim against a countercontact and the movable contact element pressing against the other countercontact when the switching mechanism is below its response temperature.

11. The switch of claim 1, wherein the first countercontact has an approximately centered contact projection with which a movable contact element of the switching mechanism is in contact below its response temperature.

12. The switch of claim 1, wherein the lower part overlaps the first countercontact in annular fashion, so that an insulating contact region is formed on the first counter-contact.

* * * * *

UNITED STATES PATENT AND TRADEMARK OFFICE

CERTIFICATE OF CORRECTION

PATENT NO. : 5,864,278
DATED : January 26, 1999
INVENTOR(S) : Michael Becher

It is certified that error appears in the above-identified patent and that said Letters Patent is hereby corrected as shown below:

On the Title Page, under "Foreign Application Priority Data"
"March 19, 1996" should be --March 9, 1996--.

Signed and Sealed this

Twenty-first Day of September, 1999

*Attest:*

Q. TODD DICKINSON

*Attesting Officer*

*Acting Commissioner of Patents and Trademarks*